US007698054B2

(12) United States Patent
Akita et al.

(10) Patent No.: US 7,698,054 B2
(45) Date of Patent: Apr. 13, 2010

(54) START-UP CONTROL DEVICE AND START-UP CONTROL METHOD FOR INTERNAL COMBUSTION ENGINE

(75) Inventors: Tatsuhiko Akita, Okazaki (JP); Mitsuto Sakai, Toyota (JP); Naoki Kurata, Nishikamo (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 51 days.

(21) Appl. No.: 12/225,430

(22) PCT Filed: Apr. 11, 2007

(86) PCT No.: PCT/IB2007/000939

§ 371 (c)(1),
(2), (4) Date: Sep. 22, 2008

(87) PCT Pub. No.: WO2007/116303

PCT Pub. Date: Oct. 18, 2007

(65) Prior Publication Data

US 2009/0177372 A1 Jul. 9, 2009

(30) Foreign Application Priority Data

Apr. 12, 2006 (JP) ..... 2006-110034

(51) Int. Cl.
*F02D 41/06* (2006.01)
*F02D 45/00* (2006.01)
*F02M 7/00* (2006.01)

(52) U.S. Cl. ..... 701/113; 123/435; 123/520

(58) Field of Classification Search ..... 701/113, 701/112, 101, 102, 115; 123/435, 478, 516, 123/519, 520, 521
See application file for complete search history.

(56) References Cited

U.S. PATENT DOCUMENTS 5,911,209 A * 6/1999 Kouda et al. ..... 123/520
6,408,825 B1 6/2002 Enoki et al.
6,736,114 B2 * 5/2004 Takahashi et al. ..... 123/491
6,889,656 B1 5/2005 Rembold et al.
6,959,697 B2 * 11/2005 Kojima ..... 123/516
7,281,520 B2 * 10/2007 Klenk et al. ..... 123/446
2005/0092302 A1 5/2005 Kojima

FOREIGN PATENT DOCUMENTS

DE 32 00 622 A1 9/1982

(Continued)

*Primary Examiner*—Hieu T Vo
(74) *Attorney, Agent, or Firm*—Oliff & Berridge, PLC

(57) ABSTRACT

An engine ECU stores a map in which a region at high temperature and high pressure, a region at low temperature and low pressure, and a region provided therebetween are defined by the relationship between the temperature and pressure of fuel and the saturation fuel vapor pressure of the fuel. The engine ECU executes a program including the following steps: when start-up of the engine is requested, detecting the engine cooling water temperature and the fuel pressure; if the detection results fall into the region, setting a pre-feed time; pre-feeding until the fuel pressure reaches a desired fuel pressure threshold; and when the fuel pressure reaches the fuel pressure threshold, starting cranking. In this way, start-up failure due to fuel vapor can be avoided without unnecessarily actuating a fuel pump.

8 Claims, 6 Drawing Sheets

FOREIGN PATENT DOCUMENTS

| | | | |
|---|---|---|---|
| EP | 1 712 777 | A1 | 10/2006 |
| EP | 1 744 038 | A1 | 1/2007 |
| JP | A-06-173806 | | 6/1994 |
| JP | A-08-505201 | | 6/1996 |
| JP | A-11-044236 | | 2/1999 |
| JP | A-2000-064874 | | 2/2000 |

* cited by examiner

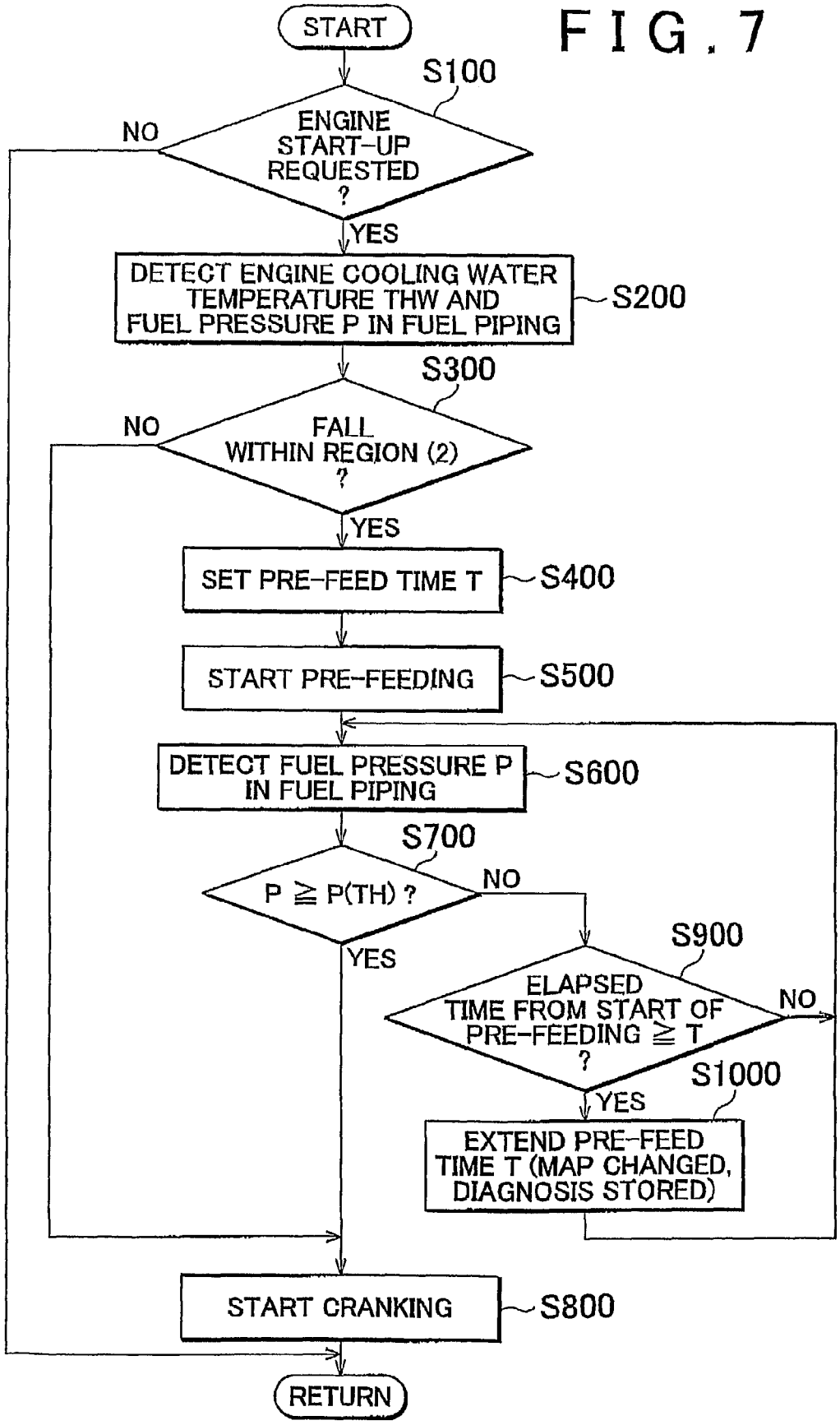
FIG. 7
START
S100
ENGINE START-UP REQUESTED ?
NO
YES
DETECT ENGINE COOLING WATER TEMPERATURE THW AND FUEL PRESSURE P IN FUEL PIPING
S200
S300
FALL WITHIN REGION (2) ?
NO
YES
SET PRE-FEED TIME T
S400
START PRE-FEEDING
S500
DETECT FUEL PRESSURE P IN FUEL PIPING
S600
S700
P ≧ P(TH) ?
NO
YES
S900
ELAPSED TIME FROM START OF PRE-FEEDING ≧ T ?
NO
YES
S1000
EXTEND PRE-FEED TIME T (MAP CHANGED, DIAGNOSIS STORED)
START CRANKING
S800
RETURN

START-UP CONTROL DEVICE AND START-UP CONTROL METHOD FOR INTERNAL COMBUSTION ENGINE

BACKGROUND OF THE INVENTION

1. Field of the Invention

The disclosure of Japanese Patent Application No. 2006-110034 filed on Apr. 12, 2006, including the specification, drawings and abstract is incorporated herein by reference in its entirety.

The present invention relates to a start-up control device and method for an internal combustion engine having either or both of a fuel injection mechanism for injecting fuel into a cylinder at high pressure (in-cylinder injector) and a fuel injection mechanism for injecting fuel into an intake port (intake passage injector), and more particularly to a technique to actuate a fuel pump before cranking.

2. Description of the Related Art

A gasoline engine is known that includes a first fuel injection valve for injecting fuel into a combustion chamber (in-cylinder injector) and a second fuel injection valve for injecting fuel into an intake passage (intake passage injector) and that adjusts the distribution of fuel between the in-cylinder injector and the intake passage injector according to the engine speed or the engine load. A direct-injection gasoline engine that includes only a fuel injection valve for injecting fuel into a combustion chamber (in-cylinder injector) is also known. Besides, a gasoline engine that includes only a fuel injection valve for injecting fuel into an intake passage (intake passage injector) is most traditionally known.

In a high-pressure fuel system which includes the in-cylinder injector, fuel pressurized by a high-pressure fuel pump is supplied to the in-cylinder injector via a delivery pipe, and the in-cylinder injector injects the pressurized fuel into a combustion chamber in each cylinder of the engine.

A diesel engine having a common rail fuel injection system is also known. In the common rail fuel injection system, fuel pressurized by a high-pressure fuel pump is reserved in a common rail, and injected from the common rail into a combustion chamber in each cylinder of the diesel engine, by opening and closing operations of an electromagnetic valve.

In order to pressurize fuel in such engines, a high-pressure fuel pump is used to drive a piston or plunger by means of a cam provided on a drive shaft coupled to a crankshaft of the engine. Engines including only an intake passage injector are not provided with such a high-pressure fuel pump.

When any type of engine including either or both of a in-cylinder injector and an intake passage injector is stopped, left alone and then restarted, a problem as described below occurs.

In any type of engine, piping from the fuel tank to the injector has an oil-tight construction. However, fuel may leak due to a seal failure, or fuel may leak from the injector if a foreign matter is caught in a fuel injection nozzle of the injector. This causes the decrease in the fuel pressure from an engine stop, which causes the fuel to boil under a reduced pressure and thus be vaporized in the piping (when the fuel pressure falls below the saturation fuel vapor pressure of the fuel, although it depends on the fuel temperature).

High-pressure fuel pumps inevitably have a clearance with its pump plunger. When fuel leaks from the clearance, the fuel having leaked is returned to the fuel tank (at atmospheric pressure) through a return pipe. This also causes the decrease in the fuel pressure from the engine stop, which causes the fuel to boil under a reduced pressure and thus be vaporized in the piping.

Such fuel vapor generated in the fuel piping prevents the pressure in the fuel piping from immediately increasing to a feed pressure, thus adversely affecting the startability of the engine. In any type of engine described above, such fuel vapor generation is caused by the decrease in pressure in the fuel piping while the engine is stopped.

JP-A-Hei 06-173806 discloses an injection system for an internal combustion engine that can ensure fuel injection from an injector even if the pressure in fuel piping decreases while the engine is stopped. This injection system for an internal combustion engine has: a fuel injection valve for injecting a desired amount of fuel into an intake passage of the internal combustion engine by appropriately controlling the communication between a supply port and an injection port for fuel; a fuel pump for pumping up fuel from a fuel tank to pressurize the fuel; a fuel path for communication between the fuel injection valve and the fuel pump; and a fuel pressure regulator provided in the fuel path to maintain the pressure of fuel in the fuel path less than a predetermined value. Fuel to be supplied to the fuel supply port of the fuel injection valve is maintained at a constant pressure. The injection system includes: a start-up prediction section for detecting a predetermined event that occurs before start-up of the internal combustion engine to predict start-up of the internal combustion engine based on the detected event; and a fuel pressurization section for increasing the pressure of fuel in the fuel path when start-up of the internal combustion engine is predicted by the start-up prediction section.

According to this injection system for an internal combustion engine, when a predetermined event that occurs before start-up of the internal combustion engine is detected (when it is detected that the door to the driver's seat has been opened by monitoring the open/close state of that door while the internal combustion engine is stopped), the pressure in the fuel path is preliminarily increased so that fuel at a predetermined pressure can be supplied to the fuel injection valve at starting up of the internal combustion engine. Thus, unlike in conventional systems, the fuel injection amount does not become unstable at starting up of the internal combustion engine, thus ensuring excellent startability of the internal combustion engine and excellent operational stability of the vehicle immediately after start-up.

In the injection system for an internal combustion engine disclosed in JP-A-Hei 06-173806 mentioned above, however, the fuel pressure is preliminarily increased when an opening operation of the door to the driver's seat is determined so that the engine is to be started, instead of whether fuel vapor is actually generated or not. If the fuel pump is operated in this way, the operating life of the fuel pump is shortened, and the so-called "NV" (Noise and Vibration) problem is caused by operation of the fuel pump before engine start-up. Even if the fuel pump is actuated only when the door to the driver's seat is opened and the fuel pressure is less than a predetermined pressure, as disclosed in an embodiment (FIG. 4) of the above-mentioned document, the fuel pump could be actuated while fuel vapor is actually not generated.

SUMMARY OF THE INVENTION

The present invention has been made in view of the foregoing problem, and provides a start-up control device and method for an internal combustion engine that can adequately avoid start-up failure without unnecessarily actuating a fuel pump.

An aspect of the present invention provides a start-up control device for an internal combustion engine, including: a detector for detecting a fuel temperature and a fuel pressure when start-up of the internal combustion engine is requested; a presumption device for presuming if fuel vapor is generated in fuel piping based on the detected fuel temperature and fuel pressure; and a controller for controlling the internal combustion engine so as to preliminarily drive a fuel pump (for supplying fuel to a fuel injection valve via the fuel piping before starting up the internal combustion engine by injecting fuel from the fuel injection valve into a combustion chamber of the internal combustion engine, when it is presumed that fuel vapor is generated and the fuel vapor affects startability of the internal combustion engine. The presumption device presumes that fuel vapor is generated when the detected fuel temperature and fuel pressure are determined to fall into a predetermined one of a plurality of regions defined by relationship between the fuel temperature and the fuel pressure and saturation fuel vapor pressure characteristics of the fuel.

Another aspect of the present invention provides a start-up control method for an internal combustion engine, including the following steps:

detecting a fuel temperature and a fuel pressure when start-up of the internal combustion engine is requested;

presuming that fuel vapor is generated in fuel piping when detected fuel temperature and fuel pressure are determined to fall into a predetermined one of a plurality of regions defined by relationship between the fuel temperature and the fuel pressure and saturation fuel vapor pressure characteristics of the fuel; and controlling the internal combustion engine so as to preliminarily drive a fuel pump for supplying fuel to a fuel injection valve via the fuel piping before starting up the internal combustion engine by injecting fuel from the fuel injection valve into a combustion chamber of the internal combustion engine, when it is presumed that fuel vapor is generated and the fuel vapor affects startability of the internal combustion engine.

According to the above start-up control device and method for an internal combustion engine, a plurality of regions are defined by the fuel temperature and the fuel pressure in consideration of the saturation fuel vapor pressure of the fuel. The regions include, for example, a region at high temperature and high pressure, a region at low temperature (low pressure), and an intermediate region provided therebetween. It is presumed that fuel vapor is generated based on the relationship with the saturation fuel vapor pressure of the fuel in the high-temperature high-pressure region and the intermediate region, of the three regions. In the high-temperature high-pressure region, there is a still residual pressure, as suggested by the expression "high-pressure," even if fuel vapor is generated. Thus, the fuel pressure can increase immediately and excellent startability can be achieved without preliminary driving the fuel pump before starting up the internal combustion engine (hereinafter referred to as "pre-feeding"), even if the fuel pump is started at the same time as a start-up request. In this way, it is not necessary to pre-feed in the high-temperature high-pressure region, even if fuel vapor is generated. On the other hand, in the low-temperature (low-pressure) region, fuel vapor is not generated. Thus, the fuel pressure can increase immediately and excellent startability can be achieved without pre-feeding, even if the fuel pump is started at the same time as a start-up request. In this way, it is not necessary to pre-feed in the low-temperature (low-pressure region), because no fuel vapor is generated. In the intermediate region, however, fuel vapor is generated and there is not a sufficient residual pressure. Thus, if the fuel pump is started at the same time as a start-up request without pre-feeding, it would take a long time for the fuel pressure to increase and excellent startability could not be achieved. In this way, it is necessary to pre-feed only in the intermediate region. To sum up, it is presumed that fuel vapor is generated when the detected fuel temperature and fuel pressure are determined to fall into the intermediate region of the plurality of regions defined by the relationship between the fuel temperature and the fuel pressure and the saturation fuel vapor pressure characteristics of the fuel, and pre-feeding is performed before cranking only when the fuel vapor affects the startability of the internal combustion engine. This allows for pre-feeding only when fuel vapor that affects the startability of the internal combustion engine is generated. As a result, it is possible to provide a start-up control device for an internal combustion engine that can adequately avoid start-up failure without unnecessarily actuating the fuel pump.

In the start-up control device for an internal combustion engine, preferably the presumption device presumes that fuel vapor that affects startability of the internal combustion engine is generated when the detected fuel temperature and fuel pressure fall into a second region, of three regions including a first region where both the fuel temperature and the fuel pressure are high, a third region where the fuel temperature is low, and the second region being provided between the first region and the third region.

Preferably the start-up control method for an internal combustion engine further includes the following steps:

defining three regions including a first region where both the fuel temperature and the fuel pressure are high, a third region where the fuel temperature is low, and a second region being provided between the first region and the third region; and presuming that fuel vapor that affects startability of the internal combustion engine is generated when the detected fuel temperature and fuel pressure are determined to fall into the second region.

In the intermediate region provided between the high-temperature high-pressure region and the low-temperature (low-pressure) region, fuel vapor is generated and there is not a sufficient residual pressure. Thus, without pre-feeding, it would take a long time for the fuel pressure to increase and excellent startability could not be achieved. According to the above start-up control device and method for an internal combustion engine, however, pre-feeding is performed only in the intermediate region, thus avoiding unnecessarily actuating the fuel pump.

In the start-up control device for an internal combustion engine, preferably the presumption device presumes that fuel vapor that affects startability of the internal combustion engine is generated when the detected fuel temperature and fuel pressure are determined to fall into a subregion of the second region where the fuel pressure is below a saturation vapor pressure line of the fuel.

In the start-up control method for an internal combustion engine, preferably it is presumed that fuel vapor that affects startability of the internal combustion engine is generated when the detected fuel temperature and fuel pressure are determined to fall into a subregion of the second region where the fuel pressure is below a saturation vapor pressure line of the fuel.

In the intermediate region between the high-temperature high-pressure region and the low-temperature (low-pressure) region, fuel vapor is not generated in a subregion above the saturation vapor pressure line of the fuel, but is generated in a subregion below that line. In the latter subregion, there is not a sufficient residual pressure. Thus, without pre-feeding, it would take a long time for the fuel pressure to increase and excellent startability could not be achieved. According to the above start-up control device and method for an internal combustion engine, pre-feeding is performed only in the subregion of the intermediate region where the fuel pressure is below the saturation vapor pressure line of the fuel, thus more reliably avoiding unnecessarily actuating the fuel pump.

In the start-up control device for an internal combustion engine, preferably a pre-feed time during which the fuel pump is preliminarily driven is set so as to be long in proportion to a degree of generation of fuel vapor.

In the start-up control method for an internal combustion engine, preferably a pre-feed time during which the fuel pump is preliminarily driven is set so as to be long in proportion to a degree of generation of fuel vapor.

According to the above start-up control device and method for an internal combustion engine, it is possible to start-up the internal combustion engine after an appropriate pre-feed time in proportion to the degree of generation of fuel vapor.

BRIEF DESCRIPTION OF THE DRAWINGS

The features, advantages thereof, and technical and industrial significance of this invention will be better understood by reading the following detailed description of preferred embodiments of the invention, when considered in connection with the accompanying drawings, in which:

FIG. 7 is a flowchart showing the control configuration of a program to be executed by an engine ECU for controlling the fuel supply system including a start-up control device according to the embodiment of the present invention.

DETAILED DESCRIPTION OF THE PREFERRED EMBODIMENTS

Figure 1:
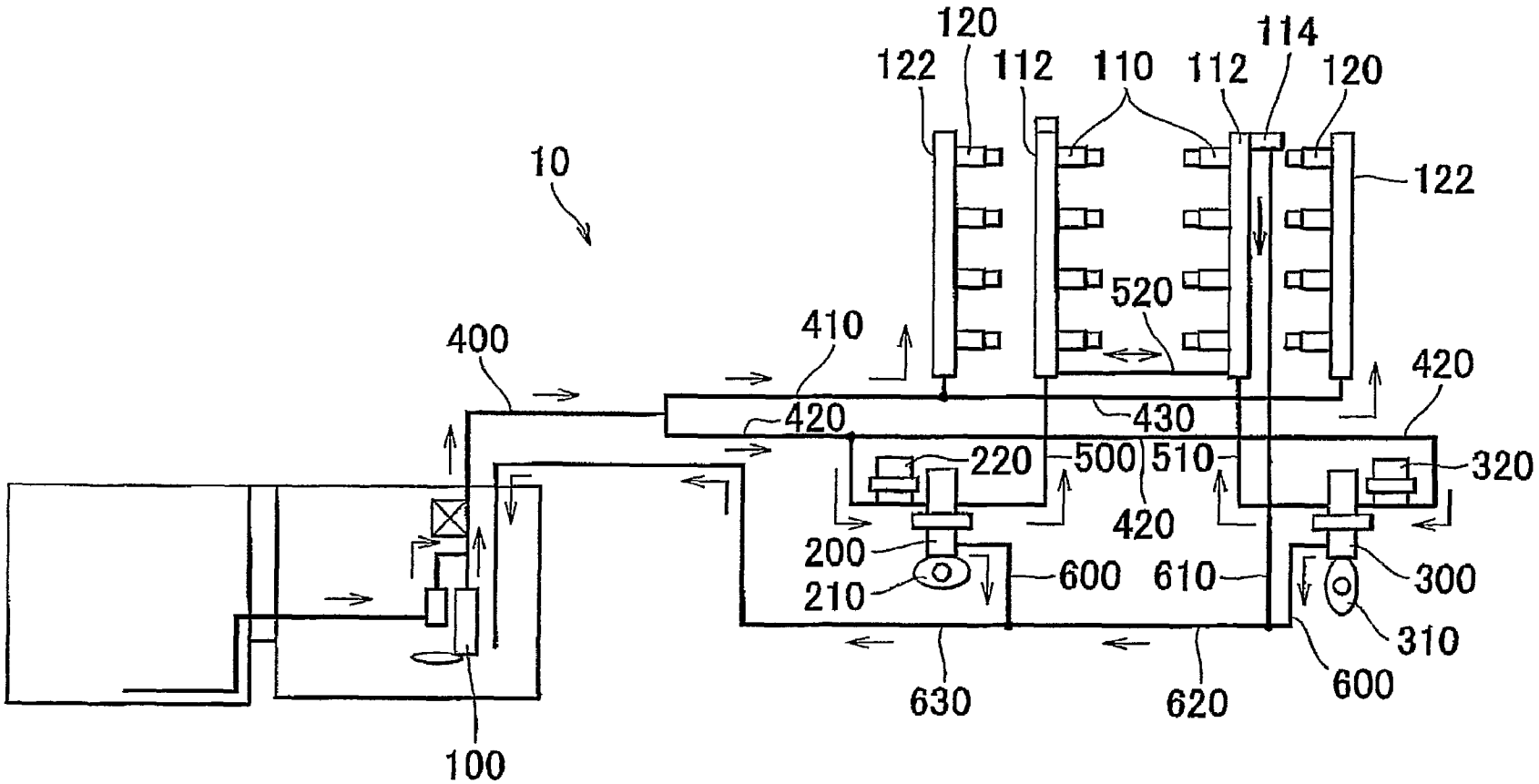
FIG. 1 is a schematic diagram showing an entire fuel supply system according to an embodiment of the present invention.

In the following description and the accompanying drawings, the present invention will be described in more detail with reference to exemplary embodiments. In the following description, identical components are given identical reference numerals. They are also given identical names and functions. Thus, the detailed description will not be repeated for the components.

FIG. 1 shows a fuel supply system 10 including a start-up control device according to an embodiment of the present invention. This engine is a V8 gasoline engine having in-cylinder injectors 110 for injecting fuel into respective cylinders and intake passage injectors 120 for injecting fuel into respective intake passages for the cylinders. The present invention may be applied not only to this type of engine, but also to other types of gasoline engines and common rail diesel engines. The engine may have more or less than two high-pressure fuel pumps.

The engine may have only either intake passage injectors or in-cylinder injectors. In engines having injectors, fuel may leak from the injectors, which may cause a decrease in pressure in fuel piping and hence generation of fuel vapor. Thus, it is effective to determine the generation of fuel vapor adequately and pre-feed fuel only when necessary. In engines having in-cylinder injectors, a clearance with a pump plunger of a high-pressure fuel pump does not ensure the oil-tight construction, which may more likely cause the decrease in fuel pressure and hence the generation of fuel vapor. Thus, the present invention can be more effectively applied to such engines having in-cylinder injectors.

As shown in FIG. 1, the fuel supply system 10 includes a feed pump 100, a first high-pressure fuel pump 200, a second high-pressure fuel pump 300, high-pressure delivery pipes 112, in-cylinder injectors 110, low-pressure delivery pipes 122, and intake passage injectors 120. The feed pump 100 is provided to a fuel tank to supply fuel at a low discharge pressure (about 400 kPa, which is the pressure of a pressure regulator). The first high-pressure fuel pump 200 is driven by a first cam 210. The second high-pressure fuel pump 300 is drive by a second cam 310 having different discharge phases from the first cam 210. The high-pressure delivery pipes 112 are provided to the respective left and right banks to provide high-pressure fuel to the in-cylinder injectors 110. The in-cylinder injectors 110 are provided to the high-pressure delivery pipes 112, and four in-cylinder injectors 110 are provided for each of the left and right banks. The low-pressure delivery pipes 122 are provided to the respective left and right banks to supply fuel to the intake passage injectors 120. The intake passage injectors 120 are provided to the low-pressure delivery pipes 122, and four intake passage injectors 120 are provided for each of the left and right banks.

The engine including the fuel supply system 10 is controlled by an engine ECU (Electronic Control Unit). Although not shown in the drawing, the engine ECU includes a CPU (Central Processing Unit) as a computation device and a memory as a storage device. The CPU executes a program to be described later, and the memory stores a map to be described later.

The discharge port of the feed pump 100 of the fuel tank is connected to a low-pressure supply pipe 400, which is branched into a first low-pressure delivery communication pipe 410 and a pump supply pipe 420. The first low-pressure delivery communication pipe 410 is connected to a second low-pressure delivery communication pipe 430 downstream thereof at a branch point with the low-pressure delivery pipe 122 for one of the V-banks. The second low-pressure delivery communication pipe 430 is connected to the low-pressure delivery pipe 122 for the other of the V-banks.

The pump supply pipe 420 is connected to each inlet of the first high-pressure fuel pump 200 and the second high-pressure fuel pump 300. A first pulsation damper 220 and a second pulsation damper 320 are provided before the inlets of the first high-pressure fuel pump 200 and the second high-pressure fuel pump 300, respectively, to reduce pulsations of fuel.

The discharge port of the first high-pressure fuel pump 200 is connected to a first high-pressure delivery communication pipe 500, which is connected to the high-pressure delivery pipe 112 for a first bank. The discharge port of the second high-pressure fuel pump 300 is connected to a second high-pressure delivery communication pipe 510, which is connected to the high-pressure delivery pipe 112 for a second bank. The high-pressure delivery pipes 112 for both of the first and second banks are connected to each other through a high-pressure communication pipe 520.

A relief valve 114 provided to the high-pressure delivery pipe 112 is connected to high-pressure fuel pump return pipes 600 via a high-pressure delivery return pipe 610. The return ports of the high-pressure fuel pumps 200 and 300 are connected to the respective high-pressure fuel pump return pipes 600. The high-pressure fuel pump return pipes 600 are connected to return pipes 620 and 630 for connection to the fuel tank.

Figure 2:
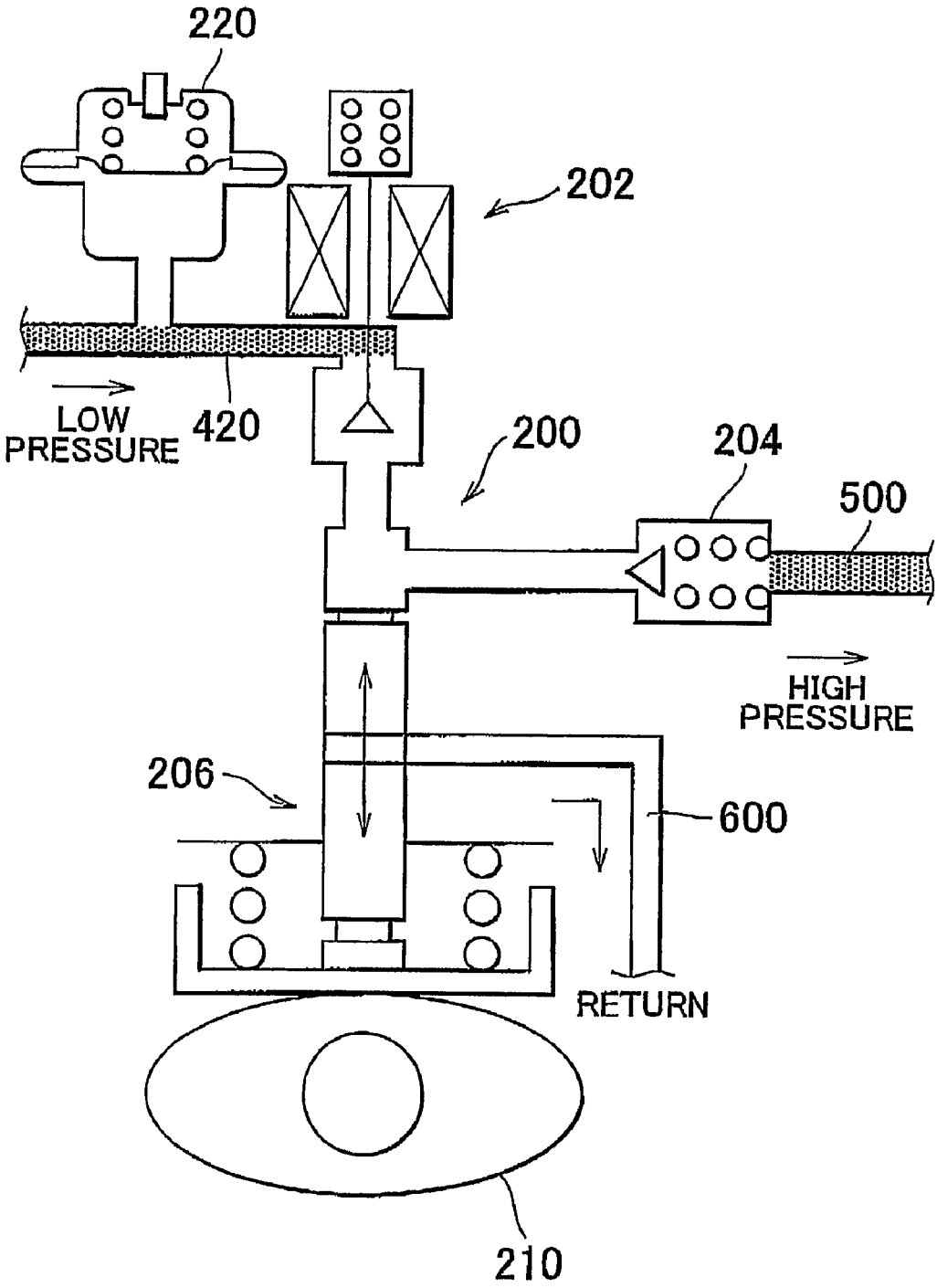
FIG. 2 is an enlarged partial view of FIG. 1.

FIG. 2 shows an enlarged view around the first high-pressure fuel pump 200 of FIG. 1. The second high-pressure fuel pump 300 is constructed in the same manner, but has different cam phases and hence different discharge timing from the first high-pressure fuel pump 200 to reduce generation of pulsations. The characteristics of the first high-pressure fuel pump 200 may be the same as or different from those of the second high-pressure fuel pump 300. The first high-pressure fuel pump 200 and the second high-pressure fuel pump 300 in the following description have the same discharge capacity according to the specifications, but have different control characteristics due to individual differences.

The high-pressure fuel pump 200 includes, as its main components, a pump plunger 206 driven by the cam 210 to slide upward and downward, an electromagnetic spill valve 202 and a leakable check valve 204.

Fuel is introduced (drawn) while the pump plunger 206 is moved downward by the cam 210 and the electromagnetic spill valve 202 is open. The amount of fuel to be discharged from the high-pressure fuel pump 200 is controlled by changing the timing to close the electromagnetic spill valve 202 while the pump plunger 206 is moved upward by the cam 210. A larger amount of fuel is discharged if the electromagnetic spill valve 202 is closed earlier during the pressurization stroke during which the pump plunger 206 is moving upward, and a smaller amount if later. The driving duty of the electromagnetic spill valve 202 when discharging the largest amount of fuel is determined as 100%, and when discharging the smallest amount, as 0%. When the driving duty of the electromagnetic spill valve 202 is 0%, the electromagnetic spill valve 202 is not closed but kept open, and thus the fuel is not pressurized, even if the pump plunger 206 is sliding upward and downward as long as the first cam 210 is rotating (as long as the engine is rotating).

The pressurized fuel forces the leakable check valve 204 (with a set pressure of about 60 kPa) open, and is delivered to the high-pressure delivery pipe 112 via the first high-pressure delivery communication pipe 500. At this time, the fuel pressure is feedback-controlled using a fuel pressure sensor provided on the high-pressure delivery pipe 112. As described above, the high-pressure delivery pipes 112 for the first and second banks are connected to each other through the high-pressure communication pipe 520.

The leakable check valve 204 is a normal check valve 204 formed with a small hole that is normally open. Thus, when the pressure of fuel on the first high-pressure fuel pump 200 (pump plunger 206) side becomes less than that in the first high-pressure delivery communication pipe 500 (for example when the engine and hence the cam 210 is stopped with the electromagnetic spill valve 202 kept open), the high-pressure fuel in the first high-pressure delivery communication pipe 500 returns to the high-pressure fuel pump 200 side, which decreases the pressure of fuel in the high-pressure delivery communication pipe 500 and the high-pressure delivery pipe 112. This allows the fuel in the high-pressure delivery pipe 112 to be depressurized while the engine is stopped, for example, thus avoiding fuel leak from the in-cylinder injectors 110.

The control amount for use in feedback control of the high-pressure fuel pump 200 is calculated from, for example, an integral renewed according to the deviation between the actual fuel pressure and the target value and a proportional increased and decreased so as to bring the deviation between the actual fuel pressure and the target value to "0." When the control amount is large, the high-pressure fuel pump 200 discharges an increased amount of fuel and the fuel pressure is increased. On the contrary, when the control amount is small, the high-pressure fuel pump 200 discharges a decreased amount of fuel and the fuel pressure is decreased.

When the actual fuel pressure becomes excessively more than the target value, both the integral and the proportional become small so as to decrease the actual fuel pressure to the target value. However, because it takes a long time to decrease the fuel pressure, the integral becomes excessively small before the actual fuel pressure decreases to the target value. If the integral becomes excessively small, the actual fuel pressure having reached the target value cannot be maintained there but decreases, thus resulting in a so-called "undershoot."

More specifically, the engine ECU controls the driving of the in-cylinder injectors 110 based on the final fuel injection amount, in order to control the amount of fuel to be injected from the in-cylinder injectors 110. Because the amount of fuel to be injected (fuel injection amount) from the in-cylinder injectors 110 is determined based on the pressure of fuel (fuel pressure) in the high-pressure delivery pipe 112 and the fuel injection time, it is necessary to maintain the fuel pressure to a suitable value in order to maintain the fuel injection amount to a suitable value. Thus, the engine ECU maintains the fuel pressure P to a suitable value through feedback-control of the fuel discharge amount of the high-pressure fuel pump 200, such that the fuel pressure obtained based on a detection signal from the fuel pressure sensor becomes closer to the target pressure P(0) set according to the engine operating state. As described above, the fuel discharge amount of the high-pressure fuel pump 200 is feedback-controlled by adjusting the closed period (closing start timing) of the electromagnetic spill valve, based on the duty ratio DT to be described later.

Now, a description is made of the duty ratio DT as the control amount for controlling the fuel discharge amount of the high-pressure fuel pump 200 (closing start timing of the electromagnetic spill valve 202). The duty ratio DT is a value associated with the cam angle of the cam 210 corresponding to the closed period of the electromagnetic spill valve 202, and varies from 0 to 100%. That is, with the cam angle corresponding to the maximum closed period of the electromagnetic spill valve 202 (maximum cam angle) defined as "?(0)" and the cam angle corresponding to the target value of the closed period of that valve (target cam angle) defined as "?," the duty ratio DT can be represented by the proportion of the target cam angle ? to the maximum cam angle ?(0). Thus, the duty ratio DT becomes closer to 100% as the target closed period (closing start timing) of the electromagnetic spill valve 202 becomes closer to the maximum closed period, and becomes closer to 0% as the target closed period becomes closer to "0."

As the duty ratio DT becomes closer to 100%, the closing start timing of the electromagnetic spill valve 202, which is adjusted based on the duty ratio DT, is advanced, thus extending the closed period of the electromagnetic spill valve 202. As a result, the fuel discharge amount of the high-pressure fuel pump 200 increases to increase the fuel pressure P. As the duty ratio DT becomes closer to 0%, the closing start timing of the electromagnetic spill valve 202 is delayed, thus shortening the closed period of the electromagnetic spill valve 202. As a result, the fuel discharge amount of the high-pressure fuel pump 200 decreases to reduce the fuel pressure P.

The pulsation damper of FIG. 1 will be described with reference to FIG. 3. The following description will be made on the pulsation damper 220 on the first high-pressure fuel pump 200 side. Since the pulsation damper 320 on the second high-pressure fuel pump 300 side has the same construction as that of the pulsation damper 220, a description of the pulsation damper 320 will not be repeated.

The pulsation damper 220 is a diaphragm type and includes a member defining an inlet port 222 and an outlet port 224, and a diaphragm 226C defining an air chamber 226B in communication with ambient air. The diaphragm 226C is supported by a spring 226D mounted in the air chamber 226B. When the pressing force of the spring 226D is more than the pressure of fuel introduced from the inlet port 222, the member defining the inlet port 222 and the outlet port 224 and a press-contact member 226A are tightly contacted with each other.

The pulsation damper 220 is provided on an intermediate portion of the pump supply pipe 420 upstream of the high-pressure fuel pump 200. The upstream and downstream sides of the pump supply pipe 420 are connected to the inlet port 222 and the outlet port 224, respectively, of the pulsation damper 220.

With this construction, pulsations that occur in the pump supply pipe 420 as fuel is discharged back from the high-pressure fuel pump 200 when the pump plunger 206 is moving upward with the electromagnetic spill valve 202 open in the high-pressure fuel pump 200 and that are transmitted to the pulsation damper 220 can be reliably reduced by vibrations of the diaphragm 226C against the spring 226D in the pulsation damper 220.

Figure 3:
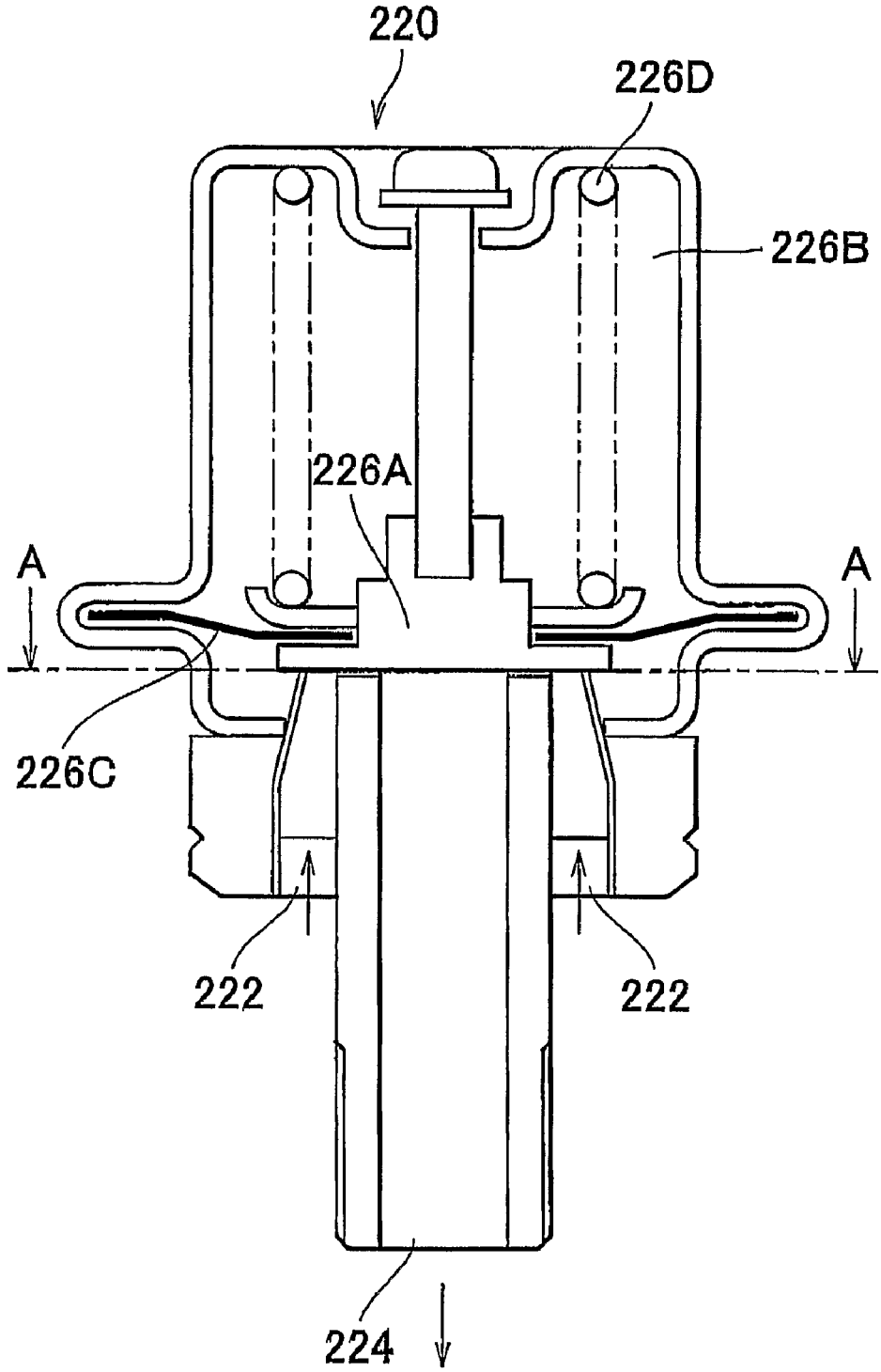
FIG. 3 is a cross sectional view of a pulsation damper of FIG. 1.
Figure 4:
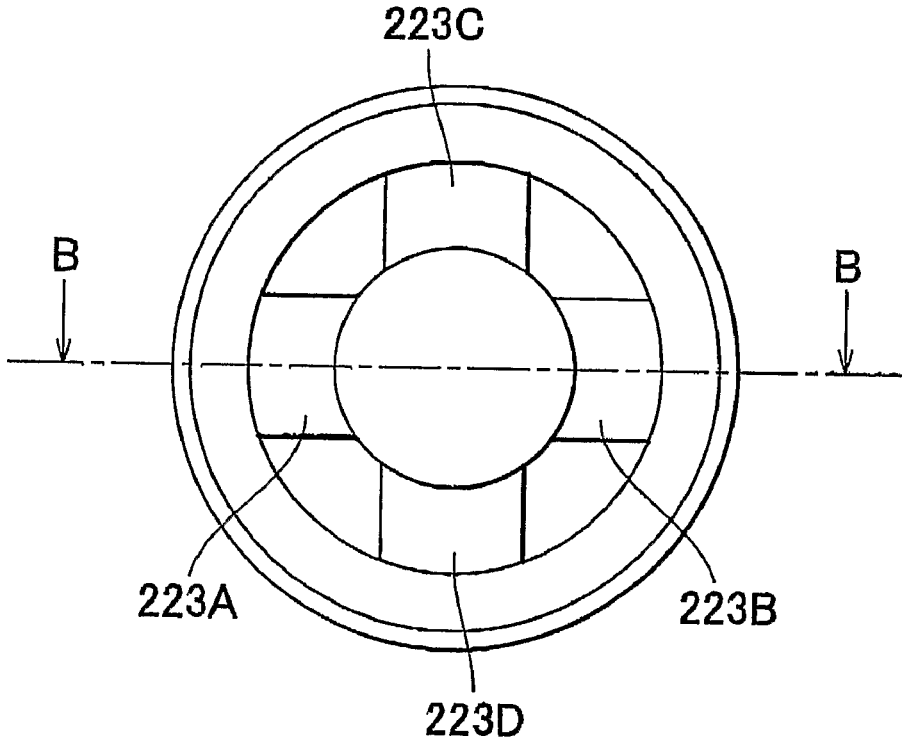
FIG. 4 is a cross sectional view taken along the line A-A of FIG. 3.
Figure 5:
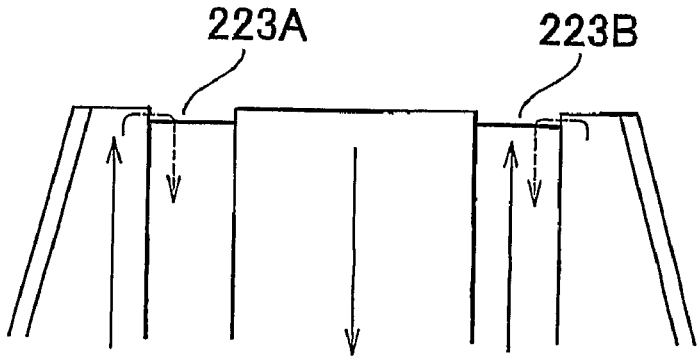
FIG. 5 is a cross sectional view taken along the line B-B of FIG. 4.

FIG. 3 shows a cross sectional view of the pulsation damper 220, FIG. 4 is a cross sectional view taken along the line A-A of FIG. 3, and FIG. 5 is a cross sectional view taken along the line B-B of FIG. 4.

As shown in FIGS. 3 to 5, the pulsation damper 220 has grooves 223A, 223B, 223C and 223D formed on an end surface (upper surface in FIG. 5) contacted by the press-contact member 226A of the pulsation damper 220. When the feed pressure is low, the press-contact member 226A is pressed by the spring 226D in contact with the upper surface of the member defining the inlet port 222 and the outlet port 224. At this time, fuel delivered from the inlet port 222 (feed pump 100 side) can flow to the outlet port 224 (high-pressure fuel pump side) through the grooves 223A, 223B, 223C and 223D, as indicated by the dotted line in FIG. 5.

When starting up a direct injection engine having only in-cylinder injectors, in particular, the high-pressure fuel pump cannot be used for delivery until the engine starts rotating, and thus the feed pump 100 is used to deliver low-pressure fuel to the in-cylinder injectors. For this reason, the pulsation damper is formed with such grooves for communication between the high-pressure piping system and the low-pressure piping system.

The pulsation damper 220 is intended to prevent pulsations in the low-pressure piping system due to operation of the high-pressure fuel pump 200, and thus normally not provided in engines having only intake passage injectors. In the case of applying the present invention to engines having only intake passage injectors, the system may be configured as having no in-cylinder injectors or high-pressure piping system (including pulsation dampers).

Figure 6:
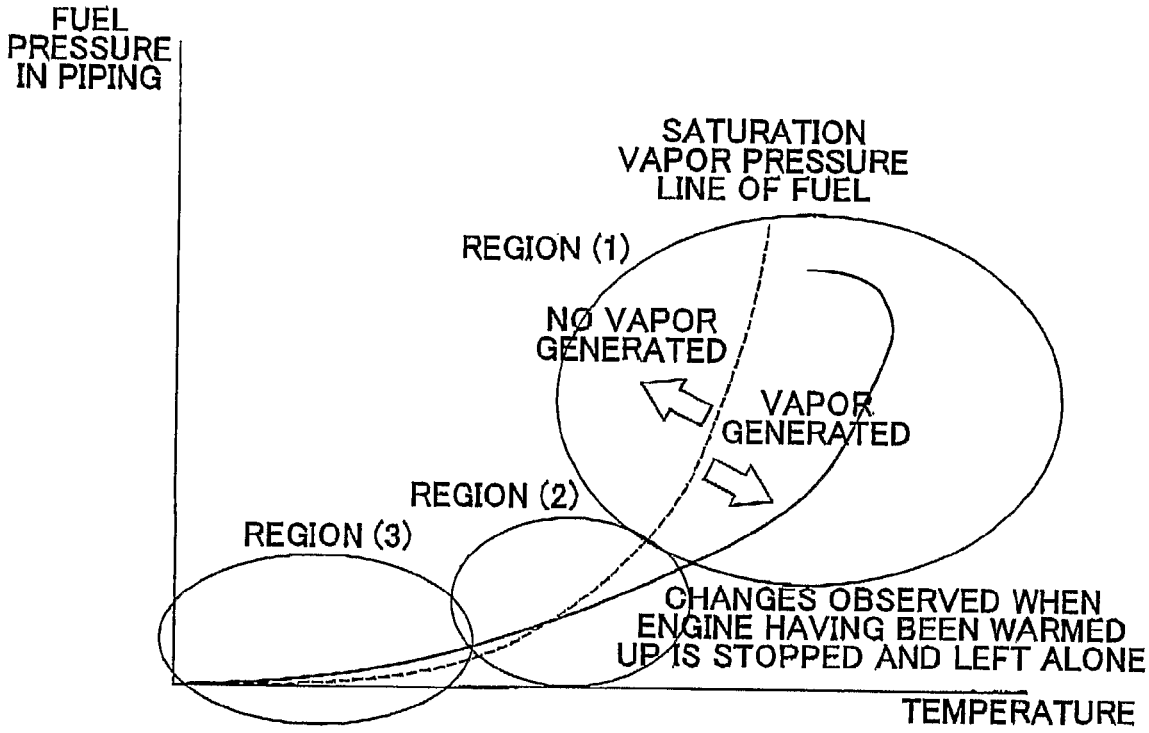
FIG. 6 is a chart showing the relationship between the fuel temperature and the fuel pressure in piping.

The relationship between the fuel temperature and the fuel pressure in piping is described with reference FIG. 6. The solid line in FIG. 6 represents changes in temperature and pressure observed when the engine having been warmed up is stopped and left alone. The dotted line in FIG. 6 represents the saturation fuel vapor pressure of fuel. In this embodiment, three regions as shown in FIG. 6 are defined.

The region (1) is at high temperature and high pressure, where fuel vapor is determined to be generated based on the fuel temperature and the fuel pressure. However, the fuel pressure is still sufficiently high (compared to the other regions). With such a residual pressure, there is no problem with the startability of the engine, because a first fuel injection at start-up will immediately reach a desired pressure of fuel even without pre-feeding (causing the feed pump 100 to operate before cranking) (because it is necessary to cause an increase only for the difference between the desired pressure and the residual pressure). At this time, the fuel is in the form of a gas-liquid mixture.

The region (3) is at sufficiently low fuel temperature, where little (or no) fuel vapor is generated because the fuel is unlikely to boil under a reduced pressure. Thus, there is no problem with the startability of the engine. At this time, the pressure of fuel immediately increases even if the feed pump 100 is actuated without pre-feeding, because there is no influence of fuel vapor.

The region (2) is at high fuel temperature but low fuel pressure, where the fuel is likely to boil under a reduced pressure. The fuel temperature is 40 to 60° C. and the fuel pressure is 20 to 40 kPa or less, for example. In this region, the pressure of fuel does not immediately increase if the feed pump 100 is actuated without pre-feeding, because of the fuel vapor generated. That is, there is a problem with the startability of the engine (an expended time is required for start-up).

Thus, it is necessary to pre-feed only in the region (2) in order to avoid worsening of the startability of the engine. In a subregion of the region (2), where the fuel pressure is equal to or over the saturation vapor pressure line of the fuel (shown in FIG. 6), since the fuel vapor that affects startability of the internal combustion engine is not generated, it is not necessary to perform the pre-feed. In a subregion of the region (2), where the fuel pressure is below the saturation vapor pressure line of the fuel, it is desirable to perform the pre-feed. The map shown in FIG. 6 is illustrative, and the present invention is not limited thereto.

A description will be made of the control configuration of the program to be executed by the engine ECU as a start-up control device according to this embodiment with reference to FIG. 7. The program (subroutine) shown in this flowchart is repetitively executed at a predetermined cycle time (for example, 80 msec).

In step (hereinafter referred to as "S") 100, the engine ECU determines whether or not an engine start-up request is detected. An engine start-up request is detected when an engine start button is pressed or an ignition switch is turned, for example. If an engine start-up request is detected (YES in S100), the process proceeds to S200. If not (NO in S100), the process ends (and this subroutine is repeated at the above cycle time to keep monitoring for an engine start-up request).

In S200, the engine ECU detects the engine cooling water temperature THW and the fuel pressure P in the fuel piping. The engine cooling water temperature THW is detected based on a signal input to the engine ECU from a water temperature sensor provided on a cooling water passage for cooling the engine. The fuel pressure P in the fuel piping is detected based on a signal input to the engine ECU from the fuel pressure sensor provided on the high-pressure delivery pipe 112. In this embodiment, the fuel temperature is replaced by the engine cooling water temperature THW, to which the present invention is not limited.

In S300, the engine ECU determines whether or not the current state falls into the region (2) of FIG. 6 based on the map shown in FIG. 6 and the detected water temperature and fuel pressure. If the current state is determined to fall into the region (2) based on the detected water temperature and fuel pressure (YES in S300), the process proceeds to S400. In not (NO in S300), the process proceeds to S800.

In S400, the engine ECU sets a pre-feed time T based on a pre-feed time map stored separately. In the pre-feed time map, the pre-feed time T becomes longer as generation of more fuel vapor is presumed based on the temperature and the fuel pressure even in the region (2).

In S500, the engine ECU starts pre-feeding. Specifically, the engine ECU-outputs an operation command signal to the feed pump 100.

In S600, the engine ECU detects the fuel pressure P in the fuel piping. In S700, the engine ECU determines whether or not the detected fuel pressure P is equal to or more than a fuel pressure threshold P(TH). The fuel pressure threshold P(TH) is set to such a value that would not cause any problem with the startability of the engine. If the detected fuel pressure P is equal to or more than the fuel pressure-threshold P(TH) (YES in S700), the process proceeds to S800. In not (NO in S700), the process proceeds to S900.

In S800, the engine ECU starts cranking. Specifically, the engine ECU outputs an operation command signal to a starter motor.

In S900, the engine ECU determines whether or not the elapsed time from the start of pre-feeding is equal to or more than the pre-feed time T set in S400. If the elapsed time from the start of pre-feeding is equal to or more than the pre-feed time T (YES in S900), the process proceeds to S1000. In not (NO in S900), the process proceeds to S600.

In S1000, the engine ECU extends the pre-feed time T set in S400. At this time, the map used in S400 to set the pre-feed time T may be changed, or the fact that the fuel pressure did not increase may be stored as a diagnosis. Then, the process returns to S600.

In the case where the fuel pressure P does not increase to the fuel pressure threshold P(TH) or more even if the pre-feed time is repetitively extended, it may be determined that a fuel system abnormality is occurring, against which measures may be implemented.

A description will be made of the operation of the engine at start-up controlled by the engine ECU as a start-up control device according to this embodiment based on the above construction and flowchart.

When it is requested that the engine having been warmed up and then left alone be started (YES in S100), the engine cooling water temperature THW and the fuel pressure P are detected (S200). Based on the detected values and the map shown in FIG. 6, it is determined whether or not the current state falls into the region (2) in FIG. 6 (S300).

[If falling into the region (2)] If the relationship between the fuel temperature (replaced by the engine cooling water temperature) and the fuel pressure falls into the region (2) (YES in S300), a pre-feed time T is set. At this time, fuel vapor is generated in the fuel piping. Pre-feeding is started and the feed pump 100 is actuated (S500).

Fuel discharged from the feed pump 100 pressurizes and thus clears the fuel vapor in the fuel piping, and then increases the fuel pressure. The fuel pressure P in the fuel piping is detected. When it becomes equal to or more than the fuel pressure threshold P(TH) (YES in S700), cranking is started (S800). At this time, because the fuel pressure has increased to or exceeded such a value that allows favorable start-up of the engine, it is possible to start-up the engine without start-up failure.

If the pre-feed time elapses (YES in S900) before the fuel pressure P in the fuel piping increases to or exceeds the fuel pressure threshold P(TH) (NO in S700), the pre-feed time is extended (S1000).

[If not falling into the region (2)] If the relationship between the fuel temperature and the fuel pressure does not fall into the region (2) but the region (1) or (3) (NO in S300), the feed pump 100 is actuated and cranking is started without pre-feeding (S800).

At this time, a residual pressure allows the fuel pressure to immediately increase to or exceed such a pressure that allows favorable start-up of the engine, in spite of the fuel vapor generated in the fuel piping (region (1)).

Alternatively, because the temperature is sufficiently low and there is no fuel vapor generated in the fuel piping, the fuel pressure can immediately increase to or exceed such a pressure that allows favorable start-up of the engine without pre-feeding (region (3)).

Thus, in both the regions (1) and (3), it is possible to start-up the engine without start-up failure without pre-feeding.

As described above, the start-up control device for an engine according to this embodiment can adequately determine whether or not fuel vapor is generated based on the fuel temperature and the fuel pressure, so as to pre-feed only when fuel vapor that affects the startability of the engine is generated. Thus, it is possible to avoid unnecessary pre-feeding, and thus shortening the useful life of the feed pump and the NV problem due to actuation of the feed pump while the engine is stopped.

The embodiment disclosed herein should be interpreted as illustrative in all respects and not restrictive. The scope of the present invention is defined not by the above description but by the appended claims, and intended to include all modifications that fall within the scope of the claims and equivalents thereof.

The invention claimed is:

1. A start-up control device for an internal combustion engine, comprising:

a detector for detecting a fuel temperature and a fuel pressure when start-up of the internal combustion engine is requested;

a presumption device for presuming if fuel vapor is generated in fuel piping based on detected fuel temperature and fuel pressure; and a controller for controlling the internal combustion engine so as to preliminarily drive a fuel pump for supplying fuel to a fuel injection valve via the fuel piping before starting up the internal combustion engine by injecting fuel from the fuel injection valve into a combustion chamber of the internal combustion engine, when it is presumed that fuel vapor is generated and the fuel vapor affects startability of the internal combustion engine, wherein the presumption device presumes that fuel vapor is generated when detected fuel temperature and fuel pressure are determined to fall into a predetermined one of a plurality of regions defined by relationship between the fuel temperature and the fuel pressure and saturation fuel vapor pressure characteristics of the fuel.

2. The start-up control device for an internal combustion engine according to claim 1, wherein the presumption device presumes that fuel vapor that affects startability of the internal combustion engine is generated when the detected fuel temperature and fuel pressure fall into a second region, of three regions including a first region where both the fuel temperature and the fuel pressure are high, a third region where the fuel temperature is low, and the second region being provided between the first region and the third region.

3. The start-up control device for an internal combustion engine according to claim 2, wherein the presumption device presumes that fuel vapor that affects startability of the internal combustion engine is generated when the detected fuel temperature and fuel pressure are determined to fall into a subregion of the second region where the fuel pressure is below a saturation vapor pressure line of the fuel.

4. The start-up control device for an internal combustion engine according to claim 1, wherein the controller sets a pre-feed time during which the fuel pump is preliminarily driven so as to be long in proportion to a degree of generation of fuel vapor.

5. A start-up control method for an internal combustion engine, comprising the following steps:

detecting a fuel temperature and a fuel pressure when start-up of the internal combustion engine is requested;

presuming that fuel vapor is generated in fuel piping when detected fuel temperature and fuel pressure are determined to fall into a predetermined one of a plurality of regions defined by relationship between the fuel temperature and the fuel pressure and saturation fuel vapor pressure characteristics of the fuel; and controlling the internal combustion engine so as to preliminarily drive a fuel pump for supplying fuel to a fuel injection valve via the fuel piping before starting up the internal combustion engine by injecting fuel from the fuel injection valve into a combustion chamber of the internal combustion engine, when it is presumed that fuel vapor is generated and the fuel vapor affects startability of the internal combustion engine.

6. The start-up control method for an internal combustion engine according to claim 5, further comprising the following steps:

defining three regions including a first region where both the fuel temperature and the fuel pressure are high, a third region where the fuel temperature is low, and a second region being provided between the first region and the third region; and presuming that fuel vapor that affects startability of the internal combustion engine is generated when detected fuel temperature and fuel pressure are determined to fall into the second region.

7. The start-up control method for an internal combustion engine according to claim 6, wherein it is presumed that fuel vapor that affects startability of the internal combustion engine is generated when the detected fuel temperature and fuel pressure are determined to fall into a subregion of the second region where the fuel pressure is below a saturation vapor pressure line of the fuel.

8. The start-up control method for an internal combustion engine according to claim 5, wherein a pre-feed time during which the fuel pump is preliminarily driven is set so as to be long in proportion to a degree of generation of fuel vapor.

* * * * *